US007093959B2

(12) United States Patent
Tsao

(10) Patent No.: US 7,093,959 B2
(45) Date of Patent: Aug. 22, 2006

(54) OUTDOOR LAMP WITH PROJECTION RANGE ADJUSTMENT

(76) Inventor: Frank Tsao, 235 Chung-Ho Box 8-24, Taipei (TW)

( * ) Notice: Subject to any disclaimer, the term of this patent is extended or adjusted under 35 U.S.C. 154(b) by 79 days.

(21) Appl. No.: 10/916,574

(22) Filed: Aug. 12, 2004

(65) Prior Publication Data

US 2006/0034080 A1 Feb. 16, 2006

(51) Int. Cl.
*F21L 4/04* (2006.01)

(52) U.S. Cl. ..... 362/277; 362/351; 362/144; 362/359; 362/285; 362/287

(58) Field of Classification Search ..... 362/351, 362/359, 144, 257, 269, 277, 285, 287
See application file for complete search history.

(56) References Cited

U.S. PATENT DOCUMENTS 6,550,932 B1 * 4/2003 Poon ..... 362/188

* cited by examiner

*Primary Examiner*—Sandra O'Shea
*Assistant Examiner*—Anabel Ton

(57) ABSTRACT

An outdoor lamp with projection range adjustment having a freely adjustable lampshade for restricting light projection range of the lamp, thereby controlling light pollution, comprises a lamp partially covered by a shell body and a lampshade pivotally mounted on the lamp. Two parallel bottom edges of the shell body extend on two corresponding lateral walls of the lamp with a predetermined angle, so that the lampshade can freely rotate about a rear portion of the lamp in a range of the predetermined angle. Further, two lateral surfaces of the lamp are each provided with an arced angle adjustment tooth row, and two lateral inner walls of the lampshade are each provided with a projected dot for engaging a corresponding angle adjustment tooth row, whereby a stepless angle adjustment can be realized.

3 Claims, 3 Drawing Sheets

OUTDOOR LAMP WITH PROJECTION RANGE ADJUSTMENT

FIELD OF THE INVENTION

The present invention relates to outdoor lamps, and more particularly to an outdoor lamp with projection range adjustment, which can satisfy a user's need for a variety of light projection ranges and thus can properly controls light pollution.

BACKGROUND OF THE INVENTION

Outdoor lamps of the prior art usually have a special lampshade designed according to various needs. To control light pollution, the unnecessary light extension that causes an uncomfortable visual effect, an outdoor is usually provide a fixed lampshade.

According to the research data, light pollution has been causing serious eye damage to people. When people choose outdoor lighting devices, the main consideration is the ornamental effect. Therefore, the illumination range and strength may go beyond a reasonable level, which not only damages people's vision but also disturbs brain functions, resulting in vertigo, sleeplessness, distraction and poor appetite. Light pollution causes even larger damages to children, since their visual ability are still developing. Therefore, effective control of light pollution is important.

Although the lampshades of the outdoor lamps of the prior art can restrict the projection range of the lamps, the projection range is however fixed and cannot satisfy the necessity of adopting different ranges in different occasions.

SUMMARY OF THE INVENTION

Accordingly, the primary object of the present invention is to provide an outdoor lamp with projection range adjustment that can avoid the above problems and meanwhile control light pollution by varying light projection range according to a user's need.

The secondary object of the present invention is to provide an outdoor lamp with projection range adjustment, wherein the relative angular displacement between the lamp and the lampshade can be adjusted continuously.

To achieve the above objects, an outdoor lamp with projection range adjustment according to the present invention comprises a lamp partially covered by a shell body and a lampshade pivotally mounted on the lamp. Two parallel bottom edges of the shell body extend on two corresponding lateral walls of the lamp with a predetermined angle, so that the lampshade can freely rotate about a rear portion of the lamp in a range defined by predetermined angle. Further, two lateral surfaces of the lamp are each provided with an arced angle adjustment tooth row, and two lateral inner walls of the lampshade are each provided with a projected dot for engaging a corresponding angle adjustment tooth row, whereby a stepless angle adjustment can be realized, without even a tool.

The various objects and advantages of the present invention will be more readily understood from the following detailed description when read in conjunction with the appended drawings.

DETAILED DESCRIPTION OF THE PREFERRED EMBODIMENTS

Figure 1:
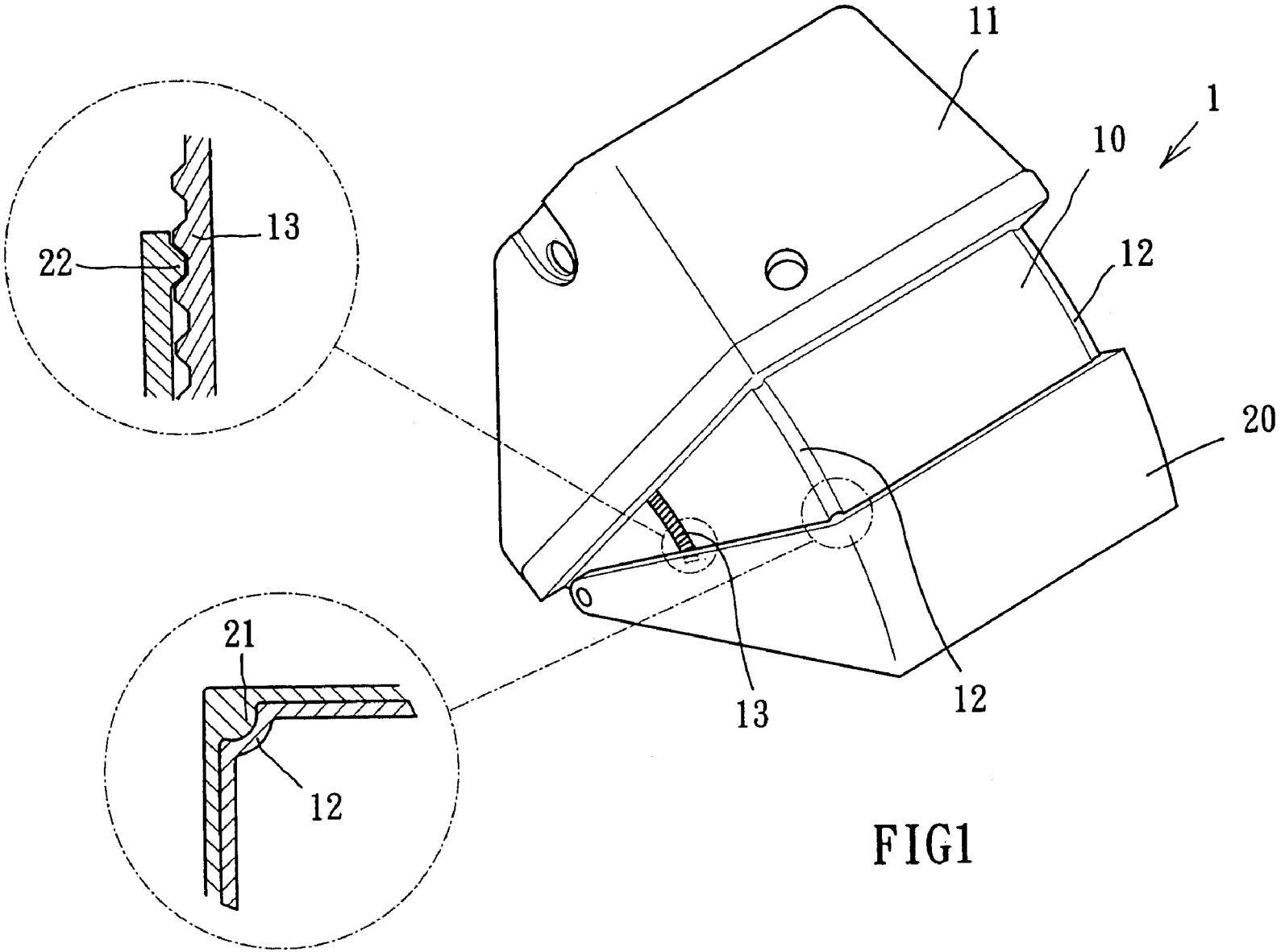
FIG. 1 is a perspective view of a preferred embodiment according to the present invention, wherein two local enlarged views are shown.

Referring to FIG. 1, an outdoor lamp 1 comprises a lamp 10 and a lampshade 20, wherein the lamp 10 is engaged with a shell body 11 at a predetermined angle. Namely, a rear bottom side of the lamp 10 and a rear bottom side of the shell body 11 are substantially overlapped so that two lateral bottom sides of the shell body 11 and two lateral bottom sides of the lamp 10 are extended outward at a predetermined angle, allowing a continuous angle adjustment. For example, the span angle of the lateral bottom sides of the lamp 10 and the shell body 11 is 20 degrees, whereby the projection angle of the lamp 10 can be continuously adjusted from 70 to 90 degrees. Further, left and right edges of the front surface of the lamp 10 are each provided with a guide groove 12, and two lateral surfaces of the lamp 10 are each provided with an arced angle adjustment tooth row 13.

The lampshade 20 is pivotally mounted under the shell body 11 at the rear ends of two lateral surfaces of the lamp 10 and encircles the lamp 10. Thereby, the lampshade 20 can rotate about the bottom edge of the rear surface of the lamp 10 within the span angle between the lateral bottom sides of the lamp 10 and the shell body 11. Two lateral edges of the inner wall of the front surface of the lampshade 20 are each provided with an elongated rib 21 for engaging a corresponding guide groove 12 and therefore stabilizing the angular sliding motion of the lampshade 20. Further, two lateral inner walls of the lampshade 20 are each provided with a projected dot 22, close to the upper edge thereof, for engaging a corresponding angle adjustment tooth row 13 on the lamp 10, thereby the angular position of the lampshade 20 with respect to the lamp 10 can be secured.

Figure 2:
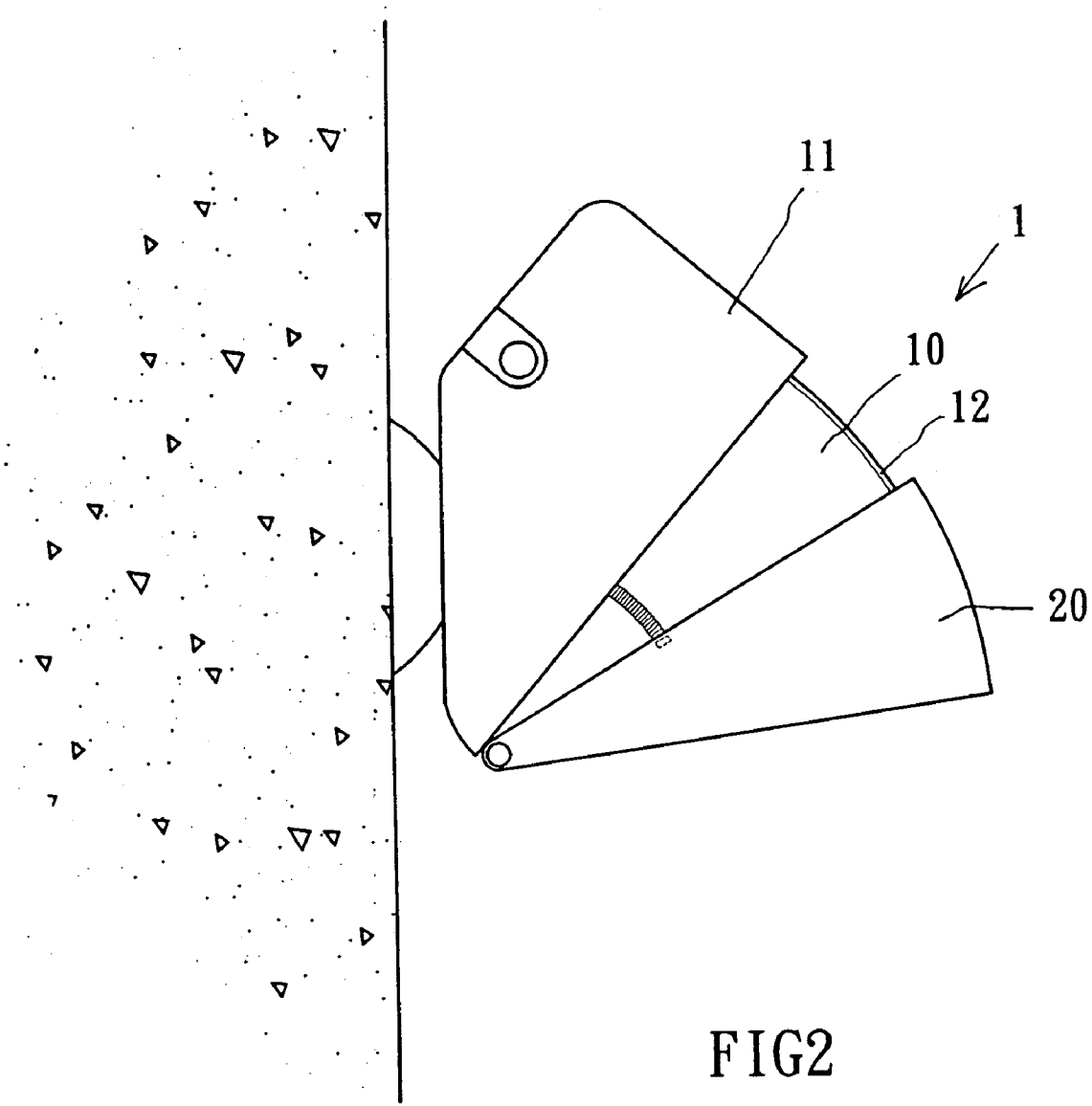
FIG. 2 is a side view of a preferred embodiment according to the present invention installed on a wall.
Figure 4:
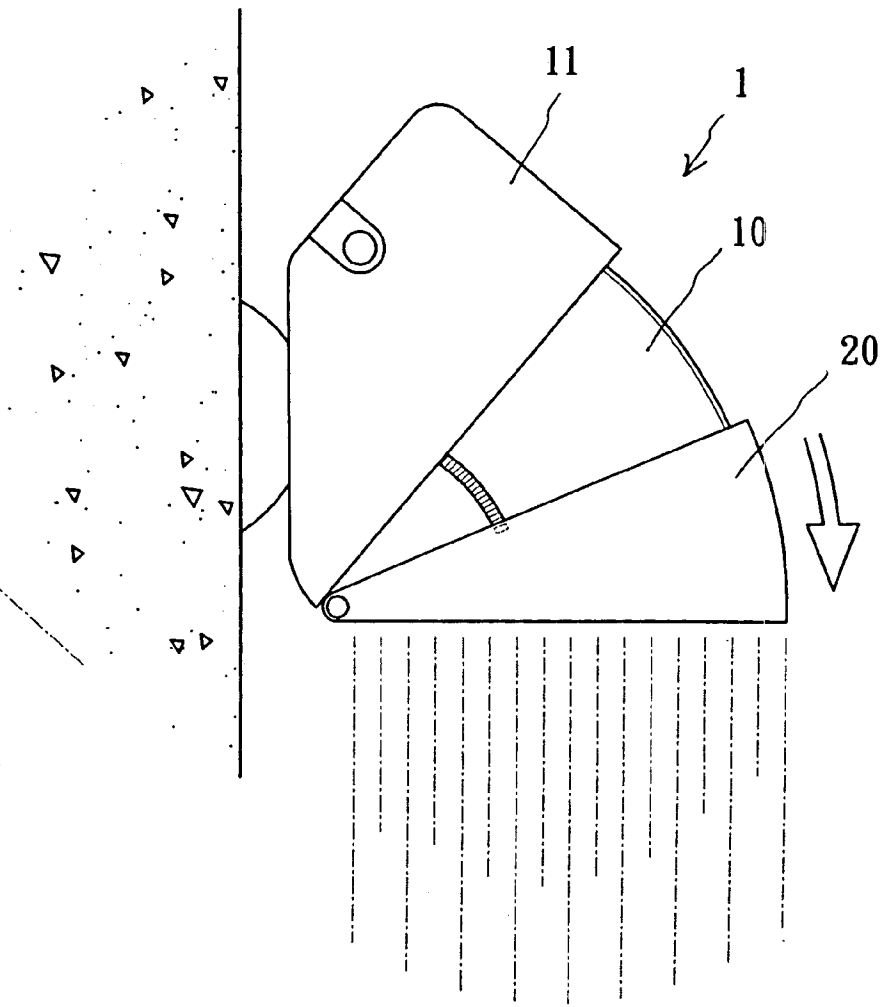
FIG. 4 shows the action of adjusting light projection range of the preferred embodiment of the present invention to a second angle.
Figure 3:
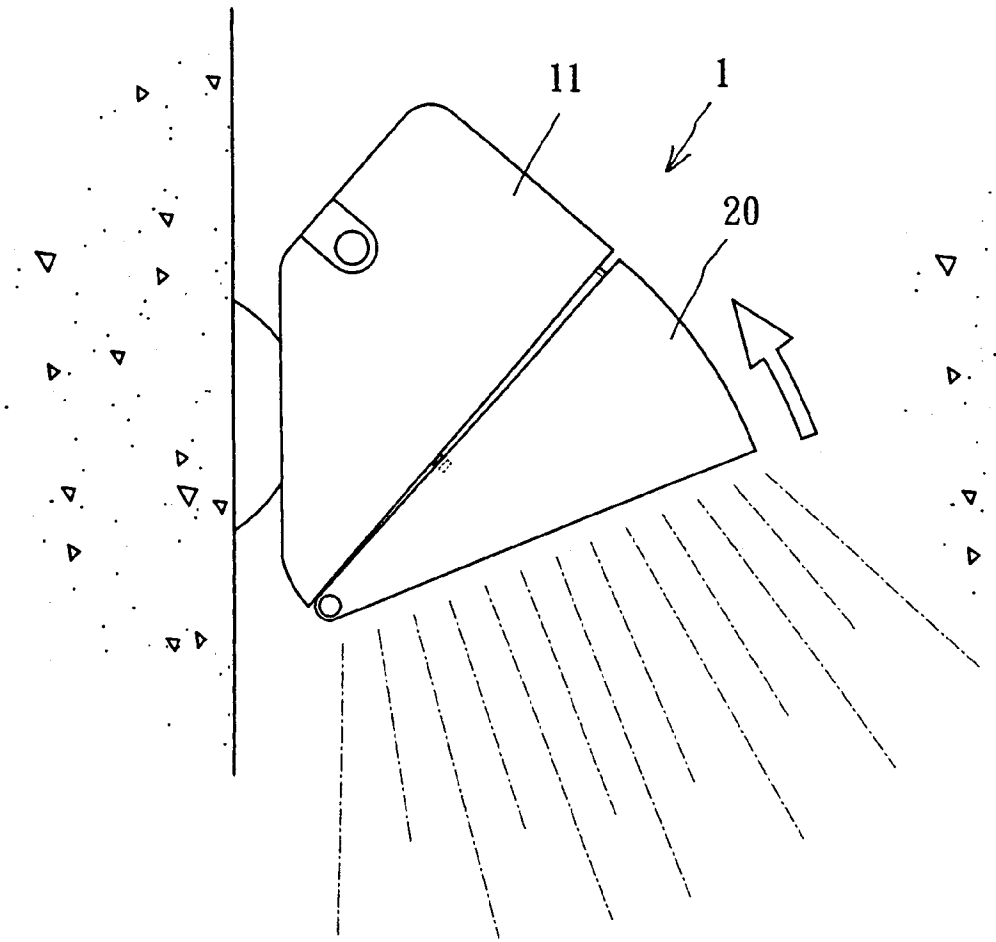
FIG. 3 shows the action of adjusting light projection range of the preferred embodiment of the present invention to a first angle.

Refer to FIG. 2 for the use of the present invention. The lamp 10 of the outdoor lamp 1 is mounted on a selected location and connected to a power supply. The lamp 10, when turned on, projects light in a range according to the mounting configuration of the lamp 10. To enlarge the light projection range, the lampshade 20 is rotated toward the shell body 11, as shown in FIG. 3. To acquire the widest possible projection range, the lampshade 20 is rotated toward till it collides with the shell body 11. To prevent light pollution, the lampshade 20 is rotated away from the shell body 11 so that the light projection range is shrunk, as shown in FIG. 4.

Therefore, the relative angular displacement between the lampshade 20 and the lamp 10 can be selected according to a user's need for illumination range. Because of the engaging mechanisms of angle adjustment tooth rows 13 with projected dots 22 and guide grooves 12 with elongated ribs 21, a stepless angle adjustment can be easily realized, without even using a tool.

According to the above disclosure, the adjusting mechanism of the light projection of the present invention can satisfy a user's need for a variety of illumination ranges and can prevent light pollution, which is indeed practical and novel.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A outdoor lamp with projection range adjustment, comprising:

a lamp, an upper half of said lamp being obliquely covered by a shell body with a predetermined tilt angle defined by the angle between two parallel bottom edges of said shell body and two bottom edges on two corresponding lateral walls of said lamp, a left edge and a right edge of a front surface of said lamp being each provided with a guide groove, two lateral surfaces of said lamp being each provided with an arced angle adjustment tooth row; and a lampshade covering a lower half of said lamp and pivotally mounted on a rear portion of said lamp just under the shell body, whereby said lampshade can rotate about said rear portion of said lamp within an angular range defined by the angle between said bottom edges of said shell body and said bottom edges on said lateral walls of said lamp, two lateral edges of an inner wall of a front surface of said lampshade being each provided with an elongated rib for engaging a corresponding one of said guide grooves and thereby stabilizing the rotation of said lampshade;

whereby the angular position of said lampshade with respect to said lamp is adjustable for enlarging and shrinking the light projection range of said lamp, and thus light pollution is controllable.

2. The outdoor lamp with projection range adjustment of claim 1 wherein upper portions of two lateral inner walls of said lampshade are each provided with a projected dot for engaging a corresponding one of said angle adjustment tooth rows on said lamp.

3. The outdoor lamp with projection range adjustment of claim 1 wherein said predetermined angle is determined by the angle extending from a vertical line connecting said lamp and the ground outwardly to a predetermined angular increment.

* * * * *